US011371317B2

(12) United States Patent
Inglis et al.

(10) Patent No.: US 11,371,317 B2
(45) Date of Patent: Jun. 28, 2022

(54) REMOTE-OPEN BARRIER VALVE

(71) Applicant: Halliburton Energy Services, Inc., Houston, TX (US)

(72) Inventors: Peter D. W. Inglis, Dundee (GB); Michael Linley Fripp, Carrollton, TX (US); Thomas Jules Frosell, Irving, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/493,356

(22) PCT Filed: Dec. 31, 2018

(86) PCT No.: PCT/US2018/068149
§ 371 (c)(1),
(2) Date: Sep. 12, 2019

(87) PCT Pub. No.: WO2020/142070
PCT Pub. Date: Jul. 9, 2020

(65) Prior Publication Data

US 2021/0363859 A1 Nov. 25, 2021

(51) Int. Cl.
*E21B 34/06* (2006.01)
*E21B 34/10* (2006.01)
(Continued)

(52) U.S. Cl.
CPC ..... *E21B 34/066* (2013.01); *E21B 34/10* (2013.01); *E21B 34/16* (2013.01); *E21B 47/12* (2013.01); *E21B 2200/04* (2020.05)

(58) Field of Classification Search
CPC ..... E21B 34/066; E21B 34/10; E21B 34/16; E21B 47/12; E21B 2200/04; E21B 34/14
See application file for complete search history.

(56) References Cited

U.S. PATENT DOCUMENTS 4,856,595 A 8/1989 Upchurch
5,412,568 A * 5/1995 Schultz ..... E21B 34/16 702/6
(Continued)

FOREIGN PATENT DOCUMENTS

GB 2583195 A 10/2020
WO WO 1999/054591 A1 10/1999
(Continued)

OTHER PUBLICATIONS

International Search Report and Written Opinion of the International Searching Authority issued for International Patent Application No. PCT/US2018/068149, dated Sep. 26, 2019, 13 pages.
(Continued)

*Primary Examiner* — Dany E Akakpo
(74) *Attorney, Agent, or Firm* — Haynes and Boone, LLP

(57) ABSTRACT

An actuation system for remotely transitioning a downhole wellbore tool between distinct operational configurations includes a sensor that can detect a downhole pressure in a tubular string extending into a wellbore and an electronic decoder that monitors the pressure the tubular string until a target pressure profile is detected. When the target pressure profile is detected, the decoder issues a command to an actuation mechanism, causing the downhole wellbore tool to transition between the distinct operational configurations. The target pressure profile may be transmitted from the surface location by operating a pump to produce specific downhole pressure levels for specific time intervals. The specific downhole pressures do not need to be applied directly to the downhole wellbore tool, and thus the each of a plurality of various downhole wellbore tools may be operated independently without interfering with one another.

19 Claims, 5 Drawing Sheets

(51) Int. Cl.
*E21B 34/16* (2006.01)
*E21B 47/12* (2012.01)

(56) References Cited

U.S. PATENT DOCUMENTS

| | | | | |
|---|---|---|---|---|
| 7,231,971 | B2 | 6/2007 | McCalvin | |
| 8,733,448 | B2 | 5/2014 | Skinner et al. | |
| 10,100,608 | B2 | 10/2018 | Fripp et al. | |
| 2014/0299330 | A1* | 10/2014 | Fripp | E21B 34/063 166/373 |
| 2015/0123808 | A1 | 5/2015 | Vick, Jr. et al. | |
| 2017/0138183 | A1 | 5/2017 | Halfmann et al. | |

FOREIGN PATENT DOCUMENTS

| | | | | |
|---|---|---|---|---|
| WO | WO-2011163491 | A2 * | 12/2011 | E21B 47/18 |
| WO | WO 2017/203287 | A1 | 11/2017 | |
| WO | WO 2018/080529 | A1 | 5/2018 | |

OTHER PUBLICATIONS

Examination Report issued for United Kingdom Patent Application No. GB2105236.0, dated Apr. 7, 2022, 3 pages.

* cited by examiner

REMOTE-OPEN BARRIER VALVE

CROSS REFERENCE TO RELATED APPLICATION(S)

The present application is a U.S. National Stage patent application of International Patent Application No. PCT/US2018/068149, filed on Dec. 31, 2018, the disclosure of which is hereby incorporated by reference in its entirety.

BACKGROUND

The present disclosure relates generally to equipment and operations for use in a subterranean wellbore. Example embodiments described herein include equipment and operations for actuating downhole wellbore tools, e.g., a ball valve, with a wireless signal transmitted from a surface location or from a remote location in the wellbore.

Wellbores are often drilled through subterranean geologic formations for hydrocarbon exploration and recovery. During drilling and production operations, evaluations may be performed on the geologic formations and fluids present in the wellbore for various purposes, such as to locate hydrocarbons or to manage the efficiency of a drilling or production operation. To perform the evaluations, a downhole wellbore tool may be deployed into the wellbore on a drill string, production tubing, wireline, coiled tubing strand or other conveyance. Once in place, the downhole wellbore tool may be activated from a surface location, e.g., to draw fluid into a sample chamber within the downhole wellbore tool. The fluid sample may be analyzed in-situ, and/or returned to the surface location with the downhole wellbore tool for further analysis.

Downhole wellbore tools other than valves may also be remotely operated to transition between different configurations within the wellbore. An actuator associated with the tool may be configured to receive a predetermined input signal transmitted from an operator at the surface location or another remote location and, in response to the input signal, transition the tool between the various distinct configurations to perform various distinct functions or operations in the wellbore.

BRIEF DESCRIPTION OF THE DRAWINGS

The disclosure is described in detail hereinafter, by way of example only, on the basis of examples represented in the accompanying figures, in which.

DETAILED DESCRIPTION

The present disclosure describes an actuation system for remotely transitioning a downhole wellbore tool between different operational configurations. The actuation system includes a sensor that can detect a downhole pressure in a tubing string extending into the wellbore, and an electronic decoder operably coupled to the sensor that monitors the pressure the tubing string until a target pressure profile is detected. When the target pressure profile is detected, the decoder issues a command to an actuator, causing the downhole wellbore tool to transition between the distinct operational configurations. The target pressure profile may be transmitted from the surface location by operating a pump to produce specific downhole pressure levels for specific time intervals. The specific downhole pressures do not need to be applied directly to the downhole wellbore tool, and thus the each of a plurality of various downhole wellbore tools may be operated independently without interfering with one another.

While the making and using of various embodiments of the present invention are discussed in detail below, it should be appreciated that the present invention provides many applicable inventive concepts, which can be embodied in a wide variety of specific contexts. The specific embodiments discussed herein are merely illustrative of specific ways to make and use the invention, and do not delimit the scope of the invention.

Figure 1:
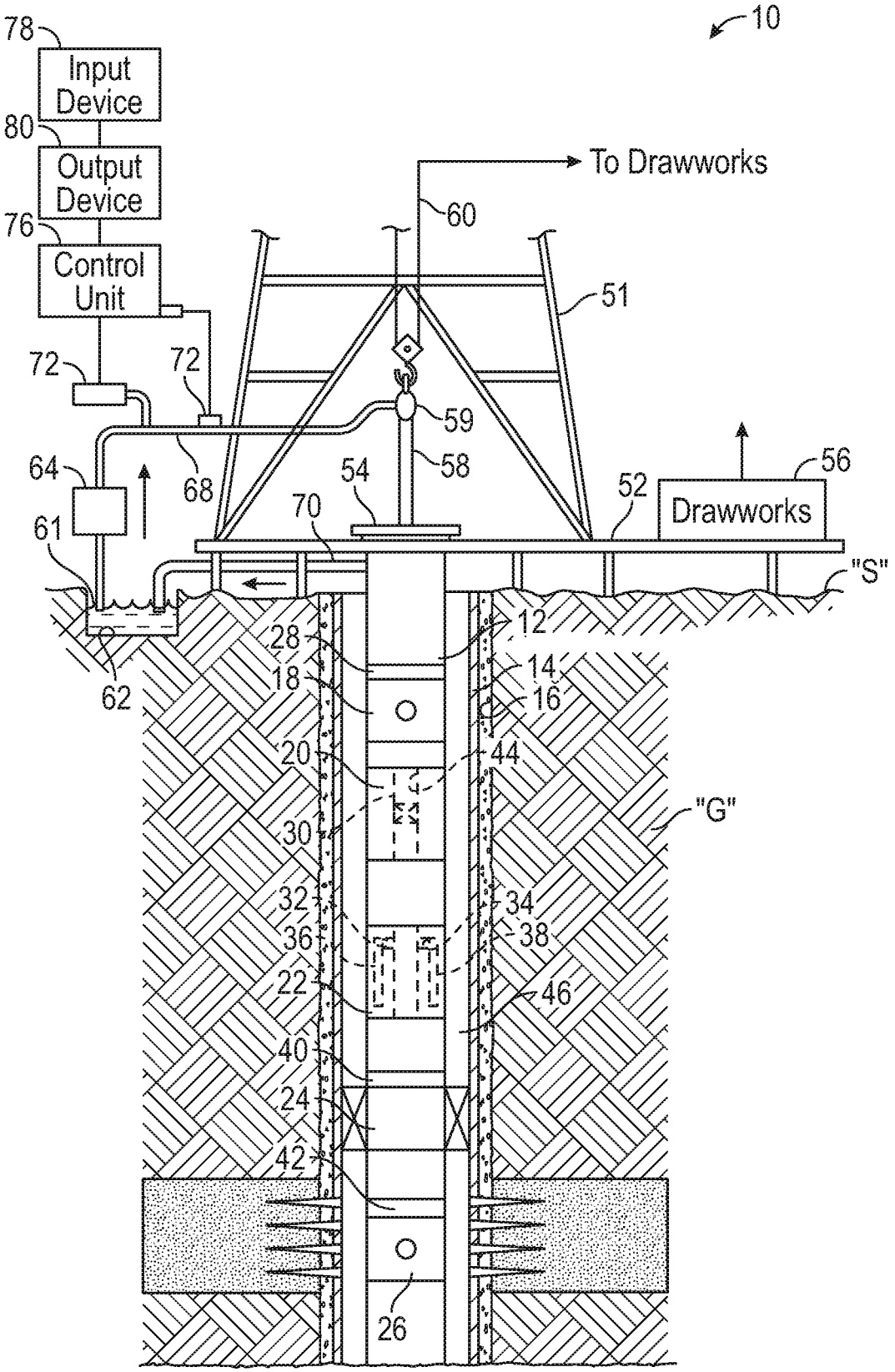
FIG. 1 is a partial, cross-sectional side view of a wellbore system including a plurality of actuators operably coupled to respective downhole wellbore tools in accordance with principles of the present disclosure.

Referring to FIG. 1, a wellbore system 10 is schematically illustrated extending from a surface location "S" through a geologic formation "G." The wellbores system 10 includes a plurality of downhole wellbore tools interconnected to form a tubular string 12 extending through a casing string 14 that is cemented in a wellbore 16. Each of the illustrated wellbore tools includes a respective actuator for transitioning the wellbore tools between distinct operating configurations or positions. Specifically, the illustrated wellbore tools are depicted as a circulation valve 18, a tester valve 20, a multi-sampler tool 22, a packer 24 and a valve 26. As depicted, actuator 28 is used to operate circulation valve 18, actuator 30 is used to operate tester valve 20, actuators 32, 34 are used to control flow into sample chambers 36, 38 of a multi-sampler tool 22, actuator 40 is used to set packer 24 and actuator 42 is used to operate valve 26.

In some embodiments, valve 26 may be configured to provide a complete blockage of flow through the tubular string 12, e.g., in the form of a barrier valve, and in other embodiments, and in some embodiments, the valve 26 is configured to provide a restriction through the tubular string 12, e.g., in the form of an adjustable choke. In still other embodiments. In still other embodiments the valve 26 may be configured as a circulation valve arranged to selectively direct fluid between an interior and exterior of the tubular string 12.

In each of these cases, the actuators 28, 30, 32, 34, 40, 42 are responsive to at least one distinct acoustic or pressure profile to operate the corresponding wellbore tool 18, 20, 22, 24, 26. For example, a first pressure profile transmitted through an interior flow passage 44 of the tubular string 12 may be detected by each of the actuators 28, 30, 32, 34, 40, 42 and compared to a distinct target pressure profile associated therewith. If the first pressure profile matches the target profile associated with actuator 40, the actuator 40 may cause the packer 24 to be set while the remaining actuators 28, 30, 32, 34, 42 maintain the respective downhole wellbore tools 18, 20, 22, 26 in their initial configurations. A second pressure profile subsequently transmitted through the tubular string 12 may match the distinct pressure profile associated with actuator 28 causing the circulation valve 18 to transition between operating configurations as described in greater detail below. Those skilled in the art will appreciate that the actuators of the present disclosure may be used to operate the corresponding wellbore tools by detecting pressure profiles transmitted through an annulus 46 defined between the tubular string 12 and casing string 14, or in other fluid passageways, without departing from the principles of the present disclosure.

Even though FIG. 1 depicts the actuators of the present invention in a specific well system, it should be understood by those skilled in the art that the actuators of the present invention are equally well suited for use with a wide variety of well tools in other types of well systems. Also, even though FIG. 1 depicts the actuators of the present invention in a vertical section of a wellbore, it should be understood by those skilled in the art that the actuators of the present invention are equally well suited for use in wells having other configurations including slanted wells, deviated wells, horizontal well or wells having lateral branches. Accordingly, it should be understood by those skilled in the art that the use of directional terms such as above, below, upper, lower, upward, downward, left, right and the like are used in relation to the illustrative embodiments as they are depicted in the figures, the upward direction being toward the top of the corresponding figure and the downward direction being toward the bottom of the corresponding figure.

At the surface location "S," the wellbore system 10 includes a tower or "derrick" 51, as it is commonly referred to in the art, that is buttressed by a derrick floor 52. The derrick floor 52 supports a rotary table 54 that is driven at a desired rotational speed to provide rotational force to the tubular string 12, if necessary. The tubular string 12 is coupled to a "drawworks" hoisting apparatus 56, for example, via a kelly joint 58, swivel 59, and line 60 through a pulley system (not shown). During a drilling operation, the drawworks 56 can be operated, in some embodiments, to raise and lower the tubular string 12 in the wellbore 16.

During wellbore operations, a suitable fluid 61 can be circulated, under pressure, out from a fluid source 62 and into the borehole 16 through the tubular string 12 by a hydraulic pump 64. As described in greater detail below, the pump 64 may be employed to generate a an acoustic or time dependent pressure profile capable of triggering the actuators 28, 30, 32, 34, 40, 42 to transition the respective corresponding wellbore tools 18, 20, 22, 24, 26. The circulated fluid 61 may comprise, for example, water, water-based muds, oil-based muds synthetic-based muds, as well as gaseous fluids. Fluid 61 passes from the pump 64 into the tubular string 12 via a fluid conduit 68 and the kelly joint 58. Fluid 61 may be discharged at the bottom of the tubular string 12 and circulated in an "uphole" direction towards the surface location "S" through the annulus 46. As the fluid 61 approaches the rotary table 54, it is discharged via a return line 70 into the fluid source 62. A variety of surface sensors 72, which are appropriately deployed on the surface of the borehole 16, operate alone or in conjunction with downhole sensors, e.g., pressure sensor 102 (FIG. 2) within the wellbore, to provide information about various operating parameters, such as fluid flow rate and pressure.

A surface control unit 76 is operable to provide instructions to control the pump 64, and thereby provide particular the acoustic or pressure profiles to instruct one or more of the specific actuators 28, 30, 32, 34, 40, 42 in the wellbore 16. The surface control unit 76 may also receive and process signals from surface and downhole sensors 72, 102 and an input device 78, which may be a keyboard, touchscreen, microphone, mouse, joystick, etc. Surface control unit 76 may present to an operator desired operational parameters and other information via one or more output devices 80, such as a display, a computer monitor, speakers, lights, etc., which may be used by the operator to control the wellbore operations. Surface control unit 76 may contain a computer, memory for storing data, a data recorder, and other known and hereinafter developed peripherals. Surface control unit 76 may also include models and may process data according to programmed instructions and respond to user commands entered through the input device 78.

Figure 2:
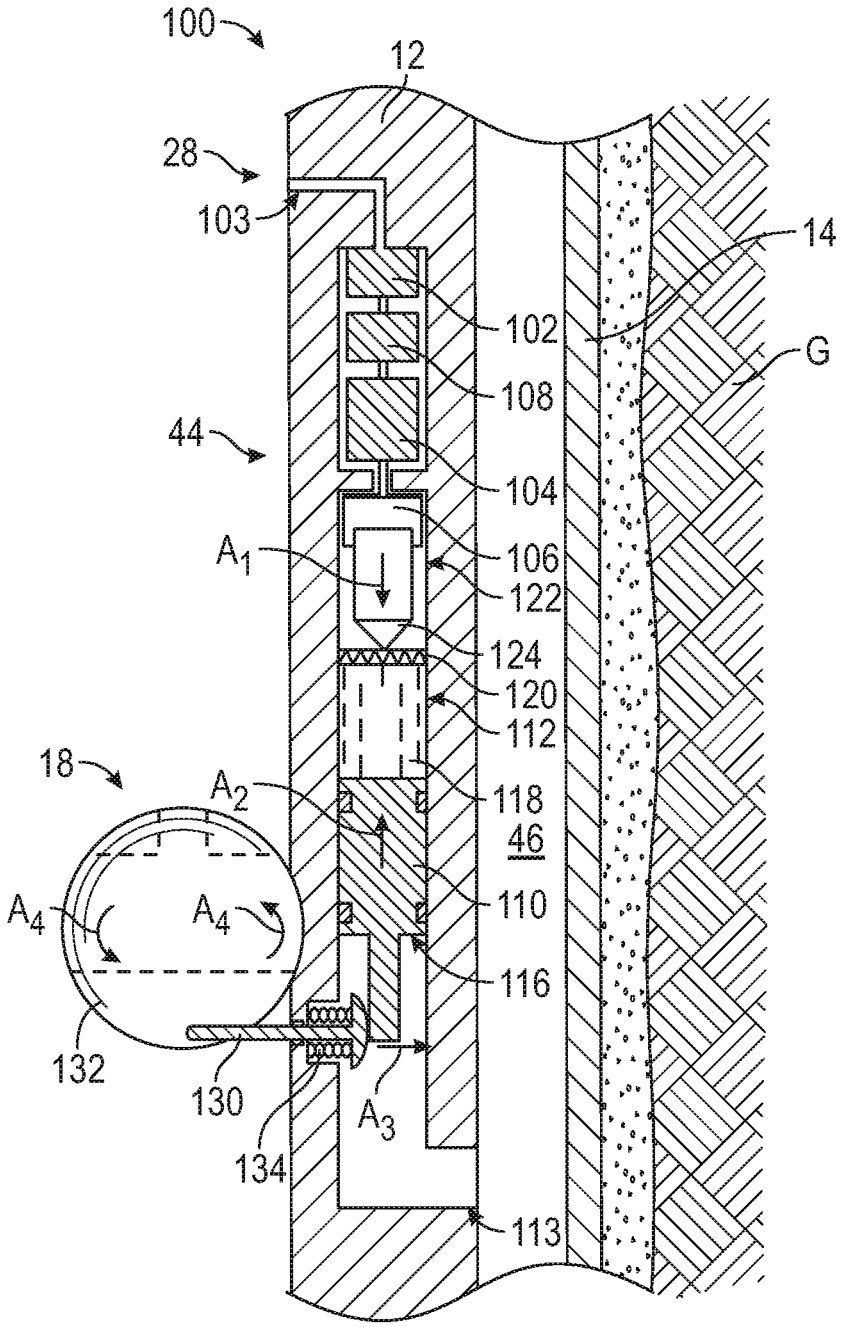
FIG. 2 is a partial schematic view of one of the actuators of FIG. 1 configured to transition a ball valve from a closed configuration to an open configuration in response to an input signal transmitted through a tubing string deployed in the wellbore.

Referring now to FIG. 2, a downhole actuation system 100 is operable for transitioning downhole wellbore tools between distinct operational configurations. Specifically, actuation system 100 includes actuator 28 for transitioning circulation valve 18 between first and second distinct operational configurations. It should be noted that the actuation system 100 may include similar components and may operate as any one of the actuators 28, 30, 32, 34, 40, 42 described above with reference to FIG. 1, or may operate as a component part or subassembly of such an actuator assembly, for example, to pilot another component of the actuator assembly or associated wellbore tool.

The actuator 28 is generally housed in a sidewall of the of the tubular string 12 and includes a receiver such as pressure sensor 102 in fluid communication with the interior flow passage 44 by a pressure port 103. The pressure sensor 102 is operable to monitor a pressure within the interior flow passage 44 and provide pressure values of the fluid 61 (FIG. 1) within the interior flow passage 44 to a decoder 104. The decoder 104 is operable to compare the pressure values received from the pressure sensor 102 with a predetermined target pressure profile associated with the specific actuator 28 to thereby determine whether the actuator 28 should be triggered to transition the circulation valve 18 between operational configurations. The decoder 104 is preferably an electronic circuit including various components such as a microprocessor, a digital signal processor, random access member, read only member and the like that are programmed or otherwise operable to recognize the predetermined target pressure profile and to thereby determine whether actuator 28 should be operated. When the decoder 104 identifies a match between the pressure values received and the target pressure profile, the decoder may issue a command to an actuation mechanism, such as pin pusher 106, which triggers the transitioning of the circulation valve 18 between operational configurations as discussed in greater detail below. The pin pusher 106 may comprise a linear motor, pneumatic piston, or similar mechanism. The decoder 104 may also include timing devices to delay or control the time period between detection of the target pressure profile and issuing the command to the pin pusher 106. The pressure sensor 102, decoder 104 and the pin pusher 106 may all be operably coupled to a battery 108 or another downhole power source to receive power therefrom.

Slidably and sealingly disposed within the sidewall of the tubular string 12 is a piston 110 that initially blocks communication between a fluid chamber 112 and a pressure port 113 extending to the annulus 46 defined between the tubular string 12 and the casing string 16. Piston 110 is biased toward the fluid chamber 112 by pressure from the annulus 46 acting on a differential piston area 116. In other embodiments (not shown), pressure from within the tubular string 12 may act upon the differential piston area 116 such that the actuator 28 is independent of pressure form the annulus. In still other embodiments, a spring (not shown) or other biasing mechanism may act upon piston 110 to provide a bias toward the fluid chamber without departing from the principles of the present disclosure. Initially, displacement of piston 110 toward the fluid chamber 112 is substantially prevented by an actuator fluid 118 disposed within the fluid chamber 112. The actuator fluid 118 is preferably a substantially incompressible fluid, such as a hydraulic fluid, but in some embodiments may alternatively be a compressible fluid such as nitrogen, a combination of substantially incompressible fluids, a combination of compressible fluids or a combination of one or more compressible fluids with one or more substantially incompressible fluids. Preferably, while actuator fluid 118 prevents piston 110 from moving toward the fluid chamber 112, the piston 110 is able to float as pressure differences in the annulus 46 and/or interior passage 44 and fluid chamber 112 are balanced.

A barrier member 120 is secured between the fluid chamber 112 and a relief chamber 122, in which the pin pusher 106 is disposed. In some embodiments, the relief chamber 122 is fluidly coupled to the inner passageway 44 of the tubular string 12 through the port 103. Barrier member 120 initially prevents actuator fluid 118 from escaping from fluid chamber 112 into the relief chamber 122. Barrier member 120 is illustrated as a disk member and is preferably formed from a metal but could alternatively be made from a plastic, a composite, a glass, a ceramic, a mixture of these materials, or other material suitable for initially containing actuator fluid 118 in fluid chamber 112, but selectively failing in response to the target pressure profile being identified by the decoder 104, and the command being issued to the pin pusher 106. In the illustrated embodiment, the pin pusher 106 advances a pin 124 in the relief chamber 122 toward the barrier member 120 to thereby fracture the barrier member 120. In other embodiments, failure of the barrier member 120 may be selectively induced by other types of actuation mechanisms configured to induce failure of the barrier member 12 by chemical reactions, combustion, mechanical weakening or other degradation of barrier member 120.

Although the actuator 28 has been described as being positioned housed within the sidewall of the tubular string 12, those skilled in the art will recognize that certain elements of actuation system 100 may alternatively be positioned outside of tubular string 14, e.g., the decoder 104 and battery 108, without departing from the principles of the present disclosure. For example, one or more of these components could be located within the circulation valve 18 or another wellbore tool that is to be actuated by actuator 28.

In operation, the pressure sensor 102 detects the pressure in the interior passageway 44 and provides pressure values to the decoder 104 over time. The decoder 104 monitors the pressure values, and determines whether the pressure values over a particular time interval match the target pressure profile saved in the decoder 104. If the decoder 104 identifies the pressure profile in the pressure values received, and thereby determines that the actuator 28 should be operated, the decoder 104 issues a command to the pin pusher 106 to advance the pin 124 (arrow $A_1$). For example, the decoder 104 may route electrical power from the battery 108 to the pin pusher 104, immediately or after an appropriate delay, to allow the pin pusher 106 to operate to induce a failure of the barrier 120. Failure of the barrier 120 creates an opening in the barrier 120 and establishes fluid communication between the fluid chamber 112 and the relief chamber 122. Actuator fluid 118 may thus exit the fluid chamber 112 and enter the relief chamber, which allows the piston 110 to be urged toward the fluid chamber 112 (arrow $A_2$) by pressure acting on differential piston area 116 from the relatively high-pressure annulus 46.

Movement of the piston 110 releases a shaft or plunger 130, which is coupled to ball valve member 132 of the circulation valve 18. The plunger 130 is illustrated as being biased in a radial direction by a biasing member such as springs 134, and thus, once the piston 110 is clear of the plunger 130, the plunger 130 is driven radially (arrow $A_3$) by the springs 134. Movement of the plunger 130 rotates the ball valve member 132 (arrows $A_4$) to transition the circulation valve 18 between distinct operational configurations, e.g., to change fluid flow patterns in the wellbore 16 (FIG. 1) as recognized in the art. Generally, the springs 134 store sufficient energy to rotate the ball valve member 132, and thus the actuation system 100 does not need to rely on any particular pressure in the interior passage 44 or annulus 46 to rotate the ball valve member 132. In some embodiments, the ball valve member 132 may be operably coupled to a second actuator (not shown) to return the ball valve member 132 to the initial configuration or to a third distinct operating configuration. The second actuator may be responsive to a target pressure profile that is distinct from the target pressure profile to which the actuator 28 is responsive.

Figure 3:
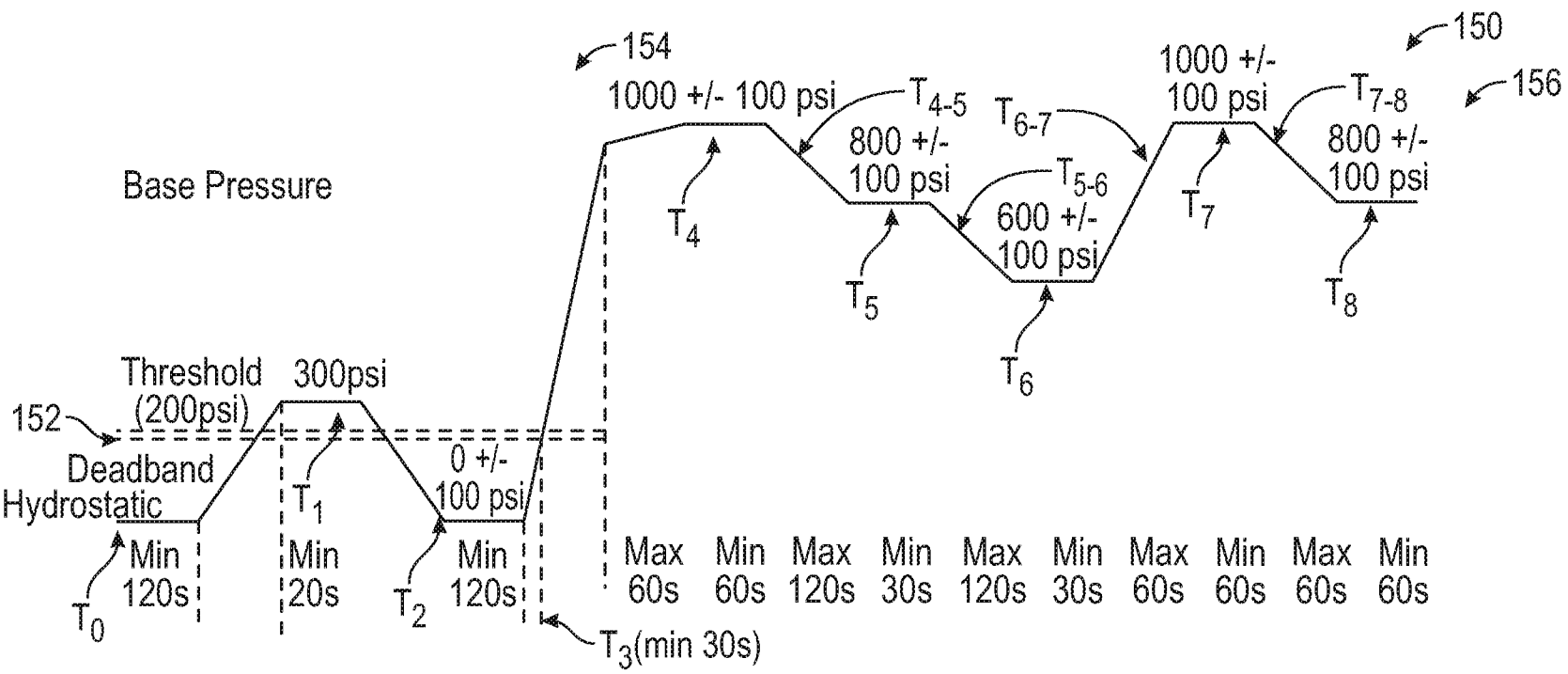
FIG. 3 is a graphical view of a time-dependent target pressure profile, which may be employed to operate the actuator and circulation valve of FIG. 2.

Referring to FIG. 3, a time-dependent pressure profile 150 is illustrated, which may be employed as a target pressure profile to induce operation of one or more of the actuators 28, 30, 32, 34, 40, 42 (FIG. 1). Each of the time and pressure values associated with the pressure profile 150 may be associated with a tolerance that can be preprogramed into the decoder 104 (FIG. 2). Initially at time $T_0$, the pressure in the interior passage 44 (FIG. 2) is maintained at a hydrostatic pressure for a minimum of 120 seconds to establish a reference point for the decoder 104. The pump 64 (FIG. 1) may be operated to raise the pressure by a preselected threshold 152 for a least a minimum time interval $T_1$, e.g., of 20 seconds. As illustrated, the threshold 152 is selected to be 200 psi above the hydrostatic pressure, but in other embodiments, the threshold may be higher or lower. After the time interval $T_1$, operation of the pump 64 may be discontinued to return the pressure to the hydrostatic reference for a minimum time interval $T_2$ of 120 seconds. Next, if the pressure is raised above the threshold for a second time within a time interval $T_3$ a preliminary portion of the pressure profile 150 may be complete. If each of the required requirements of the preliminary portion 154 are satisfied and detected by the pressure sensor 102 and decoder 104, the decoder 104 may be induced to respond in a desired manner. For example, the decoder may increase a sample rate of the pressure senor so that a secondary portion of the pressure profile may be more accurately monitored.

Additional bits of information can be added to the wireless signal to increase the confidence that the wireless signal could not be accidentally sent from a variation in background noise or normal wellbore operations. In one embodiment, these additional bits of information consist of pressure changes and time durations over which the pressure changes must be maintained. These additional bits of data are contained within a secondary portion 156 of the profile 150. As illustrated in FIG. 3, the secondary portion 156 of the pressure profile 150 includes an increase to a base pressure of 1000 psi over time interval $T_4$, and subsequent reductions and increases of pressure in an incrementally stepped manner over time intervals $T_5$, $T_6$, $T_7$ and $T_8$. Time intervals $T_4$, $T_5$, $T_6$, $T_7$ and $T_8$ may be referred to as minimum time intervals since the specific pressure associated therewith, e.g., 1000 psi±100 psi for time interval $T_4$, is maintained for a minimum of the stated time, e.g., 60 seconds for time interval $T_4$. Thus, the time intervals $T_4$, $T_5$, $T_6$, $T_7$ and $T_8$ may last longer than stated time as long as the pressure is maintained between upper and lower tolerances. Interposed between the minimum time intervals $T_4$, $T_5$, $T_6$, $T_7$ and $T_8$, are maximum transition time intervals $T_{4-5}$, $T_{5-6}$, $T_{6-7}$ and $T_{7-8}$. The maximum transition time intervals $T_{4-5}$, $T_{5-6}$, $T_{6-7}$ and $T_{7-8}$ last no longer than the stated duration, e.g., 120 seconds for $T_{4-5}$, and represent the time permitted for transitioning between the pressure levels associated with the of the adjacent time intervals. For example, transition time interval $T_{4-5}$ may begin when the detected pressure falls below the lower tolerance of time interval $T_4$, e.g., falls below 900 psi, and end when the detected pressure reaches the upper tolerance of time interval $T_5$, e.g., 900 psi.

When each of the pressures and time intervals of the pressure profile 150 are detected by the pressure sensor 102, the signals from the pressure sensor 102 may be "decoded" by the decoder 104 to establish a detected pressure profile. The decoder 104 correlates the pressure values to the time intervals and compares the detected pressure profile to the target profile stored therein. When a match is recognized between the detected and target pressure profiles, e.g., each of the pressures and time intervals of the detected pressure profile are within the tolerances associated with the pressure profile 150, the decoder 104 may issue the command to the pin pusher 106 or other actuation mechanism to induce a transition of the circulation valve 18 or other wellbore tool between distinct operating configurations. While the pressure profile 150 illustrated in FIG. 3 includes five (5) pressure steps in the secondary portion 156, it should be apparent that any number of pressure steps could be employed. There could be no pressure steps or a long chain of pressure changes.

Figure 4:
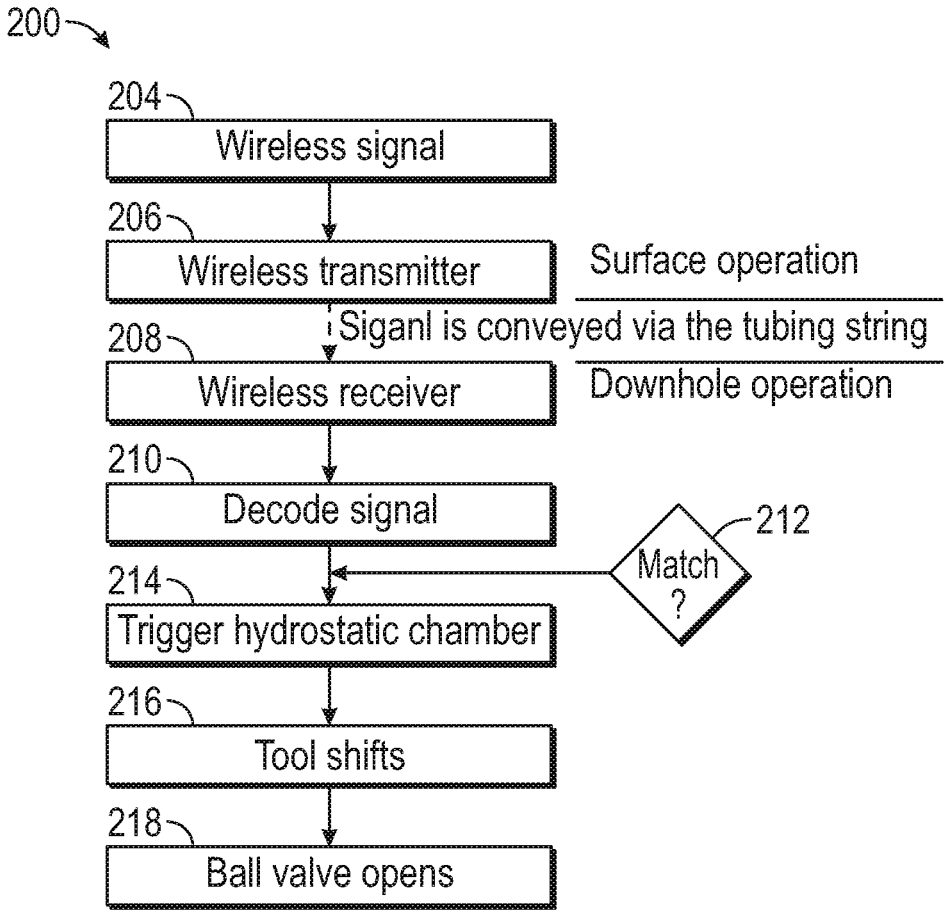
FIG. 4 is a flowchart illustrating an operational procedure for operating the actuator and ball valve of FIG. 2.

Referring now to FIG. 4, and to FIGS. 1 and 2, an operational procedure 200 for selectively operating the actuator 28 and circulation valve 18 are illustrated. Initially at step 204, a wireless signal is generated at the surface location "S." An operator may input a request with input 78 to cause the control unit 76 to generate instructions for the pump 64 or another wireless transmitter, which is predetermined to generate the target pressure profile downhole. At step 206, the pump 64 receives the instructions from the control unit 76 and operates to generate the pressure profile 150, and thereby convey the wireless signal down the tubular string 12.

At step 208, the pressure sensor 102 or other wireless receiver at a downhole location detects the pressure profile conveyed downhole. The pressure sensor 102 provides pressure readings to the decoder 104, which decodes the signal at step 210 to establish a detected pressure profile. The decoder 104 compares the detected pressure profile with a target pressure profile at step 212 to determine if there is a sufficient match. When a sufficient match is detected, the decoder 104 instructs the pin pusher 106 to advance. At step 214 the pin pusher 106 advances to establish fluid communication between the fluid chamber 112 and the relief chamber 122. The movement of the actuator fluid 118 from the fluid chamber 112 to the relief chamber 122 permits the piston 110 to shift toward the fluid chamber 112. The shifting or the piston 110 releases the plunger 130, and the bias of the springs 134 draws the plunger radially. At step 218, the movement of the plunger causes the ball valve member 132 to rotate, opening the circulation valve 218.

Figure 5:
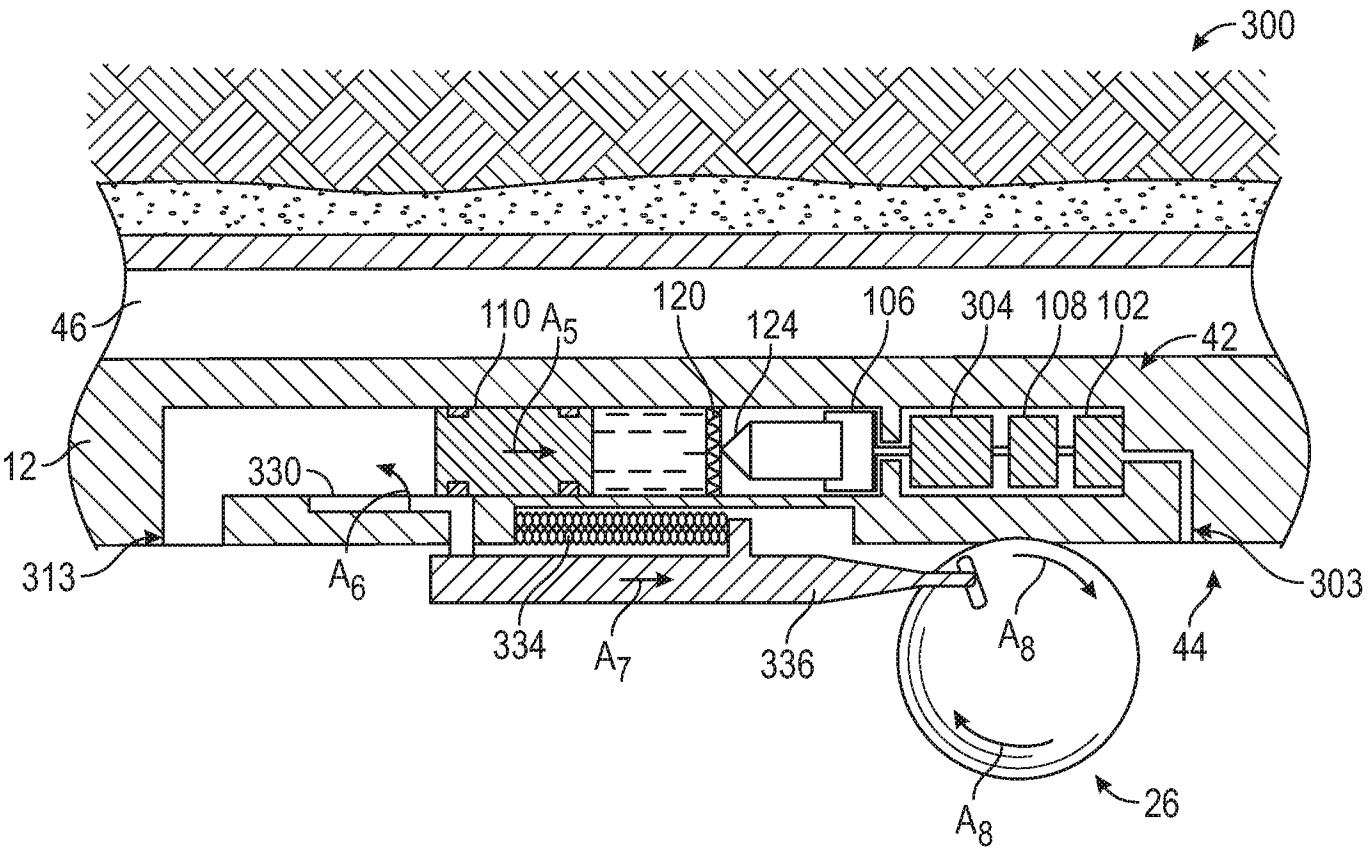
FIG. 5 is a partial schematic view of another one of the actuators of FIG. 1 configured to release a latch to transition a ball valve from an open configuration to a closed configuration in response to an input signal transmitted through the tubing string deployed in the wellbore.

Referring now to FIG. 5, a downhole actuation system 300 is operable for transitioning downhole wellbore tools between distinct operational configurations. Specifically, actuation system 300 includes actuator 42 for transitioning valve 26 between first and second distinct operational configurations. It should be noted that the actuation system 300 may include similar components and may operate as any one of the actuators 28, 30, 32, 34, 40, 42 described above with reference to FIG. 1, or may operate as a component part or subassembly of such an actuator assembly, for example, to pilot another component of the actuator assembly or associated wellbore tool.

Similar to actuator 28 (FIG. 2) described above, the actuator 42 is generally housed in the sidewall of the of the tubular string 12 and includes pressure sensor 102 in fluid communication with the interior flow passage 44 by a pressure port 303. The pressure sensor 102 is operably coupled to decoder 304, which is operable to compare the pressure values received from the pressure sensor 102 with a predetermined target pressure profile that may be similar or different than the target pressure profile associated actuator 28. When the decoder 304 identifies a match between the pressure values received and the target pressure profile, the decoder 304 may issue a command to pin pusher 106, which may be operably coupled to battery 108. The pin pusher 106 advances pin 124 to rupture a barrier member 120, and thereby allow piston 110 to move in the direction of arrow $A_5$ under the influence of pressure from the tubular string 12 acting through pressure port 313.

As illustrated in FIG. 5, the actuator 42 may be independent of a pressure in the annulus 46. For example, since the pressure port 313 provides communication with the pressure in the tubular string 12 rather than the in the annulus 46 (as opposed to the pressure port 113 described above with reference to FIG. 2). In other embodiments, the pressure port 313 may provide communication with pressure in a pre-charged fluid reservoir (not shown) housed within the actuator 42. In still other embodiments, a spring or other biasing member may provide the force necessary to move the piston 110 in the direction of arrow $A_5$ once the barrier member 120 is ruptured.

Movement of the piston 110 releases a latch 330, which is held in tension by a biasing member such as springs 334. The springs 334 are compressed between the sidewall of the tubular string 12 and a shaft 336, which is engaged with the latch 330. Once the piston 110 moves past the latch 330, the latch 330 is free to move in the direction of arrow $A_6$ thereby disengaging the latch 330 from the shaft 336. Disengagement of the latch 330 permits the shaft 336 to move in the direction of arrow $A_7$ under the bias of the springs 334. The shaft 336 is pinned or otherwise coupled to a valve member 344 such that movement of the shaft 336 in the direction of arrow $A_7$ rotates the valve member 344 in the direction of arrows $A_8$. The rotation of the valve member 344 by 90 degrees may transition the valve 26 from the open configuration illustrated to a closed configuration wherein flow through the flow passage 44 is restricted.

As illustrated in FIG. 5, the pressure port 303 is illustrated downhole of the valve member 334. In other embodiments, the pressure port 303 may be positioned uphole of the valve member 344 or in other locations without departing from the scope of the disclosure.

The aspects of the disclosure described below are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a wireless actuation system for downhole wellbore tools. The system includes a tubular string extending from a surface location to a downhole location in a wellbore extending through a geologic formation. A transmitter is selectively operable to communicate a pressure profile into a fluid within the tubing string, and a sensor is disposed at the downhole location to detect the pressure profile. A decoder is operably coupled to the sensor, the decoder operable to compare the pressure profile detected to a target pressure profile. An actuator is operably coupled to the decoder such that the decoder does not instruct the actuator to operate when the pressure profile detected is distinct from the target pressure profile and instructs the actuator to operate when the pressure profile detected matches the target profile. The system also includes a wellbore tool operably coupled to the actuator such that wherein the wellbore tool is maintained in an initial configuration until the actuator is operated and is induced to transition to a distinct operational configuration by the operation of the actuator.

In one or more example embodiments, the target pressure profile includes at least one minimum time interval over which a specific pressure is maintained between upper and lower tolerances. The target pressure profile may include a plurality of minimum time intervals over which an incrementally-stepped plurality of pressure levels is maintained between upper and lower tolerances. In some embodiments, at least one maximum time interval is interposed between the minimum time intervals of the incrementally-stepped plurality of pressure levels. In some embodiments, the target pressure profile further includes a threshold pressure that is exceeded within a minimum time interval.

In some example embodiments, the actuator includes a barrier member fluidly isolating an actuator fluid in a fluid chamber from a relief chamber, and an actuation mechanism operable to induce failure of the barrier member to thereby establish fluid communication between the fluid chamber and the relief chamber. In some embodiments, the system further includes a piston operably coupled to the actuator fluid such that flow of the actuator fluid into the relief chamber upon failure of the barrier member induces movement of the piston from a first position to a second position with respect to the fluid chamber.

Some embodiments further include a shaft biased by a biasing member, the shaft constrained from movement when the piston is in the first position and permitted to move under the bias of the biasing member when the piston is in the second position, and wherein the shaft is operably coupled to the downhole wellbore tool to transition the downhole wellbore tool between distinct operational configurations in response to movement of the plunger under the bias of the biasing member. In some embodiments the piston includes a surface area in pressure communication with either the tubular string or an annulus defined around the tubular string in the wellbore, and wherein a pressure from the tubular string or the annulus acting on the surface area is balanced by the actuator fluid in the fluid chamber.

In one or more example embodiments, the downhole wellbore tool includes either a circulation valve operable to selectively direct fluid between an interior and exterior of the tubular string or a barrier valve operable to selectively permit or restrict flow through the tubular string.

In another aspect, the disclosure is directed to a method of actuating a wellbore tool. The method includes (i) generating a wireless signal at a surface location that is predetermined to generate the target pressure profile downhole, (ii) conveying the wireless signal from the surface location to a downhole location in a wellbore through a fluid within a tubular string extending into the wellbore, (iii) monitoring a pressure of the fluid at the downhole location over a time interval to determine pressure values corresponding to different times within the time interval, (iv) decoding the pressure values to establish a detected pressure profile, (v) comparing the detected pressure profile with the target pressure profile, and (vi) instructing an actuation mechanism to operate in response to identifying a match by the comparing, wherein operation of the actuation mechanism induces transitioning a wellbore tool between distinct operational configurations within the wellbore.

In some example embodiments, comparing the detected pressure profile with the target pressure profile includes determining whether the detected pressure profile includes at least one minimum time interval over which a specific pressure is maintained between upper and lower tolerances. Comparing the detected pressure profile with the target pressure profile may further include determining whether the detected pressure profile includes a plurality of minimum time intervals over which an incrementally-stepped plurality of pressure levels is maintained between upper and lower tolerances and at least one maximum time interval interposed between the minimum time intervals of the incrementally-stepped plurality of pressure levels. In some embodiments, generating the wireless signal includes increasing a pump rate to cause the detected pressure profile to include a threshold pressure that is exceeded within a minimum time interval.

In one or more example embodiments, the method further includes inducing failure of a barrier member to establish fluid communication between a fluid chamber and a relief chamber to thereby induce movement of a piston from a first position to a second position with respect to the fluid chamber. Movement of the piston from the first position to the second position may permit a shaft to move under a bias of a biasing member, and wherein movement of the shaft induces the downhole wellbore tool to transition between distinct operational configurations. In some embodiments the method further includes balancing a pressure from either the tubular string or an annulus defined around the tubular string acting on a surface area of the piston by an actuator fluid in the fluid chamber In another aspect, the disclosure is directed to a downhole apparatus. The downhole apparatus includes a tubular string operable for deployment into a wellbore. A sensor is coupled to the tubular string, the sensor operable to detect a pressure profile conveyed through the tubular string. A decoder is operably coupled to the sensor, the decoder operable to compare the pressure profile detected to a target pressure profile. An actuator is operably coupled to the decoder such that the instructs the actuator to operate when the pressure profile detected matches the target profile, and a wellbore tool is operably coupled to the actuator such that the wellbore tool is maintained in an initial configuration until the actuator is operated and is induced to transition to a distinct operational configuration by the operation of the actuator.

In some embodiments, the wellbore tool includes either a circulation valve operable to selectively direct fluid between an interior and exterior of the tubular string or a barrier valve operable to selectively permit or restrict flow through the tubular string. In some example embodiments, the actuator includes a barrier member fluidly isolating an actuator fluid in a fluid chamber from a relief chamber, and an actuation mechanism operable to induce failure of the barrier member to thereby establish fluid communication between the fluid chamber and the relief chamber.

The Abstract of the disclosure is solely for providing the United States Patent and Trademark Office and the public at large with a way by which to determine quickly from a cursory reading the nature and gist of technical disclosure, and it represents solely one or more examples.

While various examples have been illustrated in detail, the disclosure is not limited to the examples shown. Modifications and adaptations of the above examples may occur to those skilled in the art. Such modifications and adaptations are in the scope of the disclosure.

What is claimed is:

1. A wireless actuation system for wellbore tools, the system comprising:

a tubular string extending from a surface location to a downhole location in a wellbore extending through a geologic formation;

a transmitter selectively operable to communicate a pressure profile into a fluid within the tubing string;

a sensor disposed at the downhole location to detect the pressure profile;

a decoder operably coupled to the sensor, the decoder operable to compare the pressure profile detected to a target pressure profile;

an actuator operably coupled to the decoder such that the decoder does not instruct the actuator to operate when the pressure profile detected is distinct from the target pressure profile and instructs the actuator to operate when the pressure profile detected matches the target profile;

a release member operably coupled to the actuator to move from a first position to a second position in response to operation of the actuator;

a plunger biased by a biasing member, the plunger constrained from movement when the release member is in the first position and permitted to move under the bias of the biasing member when the release member is in the second position; and a wellbore tool operably coupled to the plunger such that the wellbore tool is maintained in an initial configuration until the actuator is operated, and is induced to transition to a distinct operational configuration by the operation of the actuator, movement of the release member to the second position and movement of the plunger under the bias of the biasing member.

2. The system according to claim 1, wherein the target pressure profile includes at least one minimum time interval over which a specific pressure is maintained between upper and lower tolerances.

3. The system according to claim 2, wherein the target pressure profile includes a plurality of minimum time intervals over which an incrementally-stepped plurality of pressure levels is maintained between upper and lower tolerances.

4. The system according to claim 3, wherein at least one maximum time interval is interposed between the minimum time intervals of the incrementally-stepped plurality of pressure levels.

5. The system according to claim 1, wherein the target pressure profile further includes a threshold pressure that is exceeded within a minimum time interval.

6. The system according to claim 1, wherein the actuator comprises a barrier member fluidly isolating an actuator fluid in a fluid chamber from a relief chamber, and an actuation mechanism operable to induce failure of the barrier member to thereby establish fluid communication between the fluid chamber and the relief chamber.

7. The system according to claim 6, wherein the release member comprises a piston operably coupled to the actuator fluid such that flow of the actuator fluid into the relief chamber upon failure of the barrier member induces movement of the piston from the first position to the second position with respect to the fluid chamber.

8. The system according to claim 7, wherein the piston comprises a surface area in pressure communication with either the tubular string or an annulus defined around the tubular string in the wellbore, and wherein a pressure from the tubular string or the annulus acting on the surface area is balanced by the actuator fluid in the fluid chamber.

9. The system according to claim 1, wherein the wellbore tool comprises either a circulation valve operable to selectively direct fluid between an interior and exterior of the tubular string or a barrier valve operable to selectively permit or restrict flow through the tubular string.

10. A method of actuating a wellbore tool, the method comprising:

generating a wireless signal at a surface location that is predetermined to generate a target pressure profile downhole;

conveying the wireless signal from the surface location to a downhole location in a wellbore through a fluid within a tubular string extending into the wellbore;

monitoring a pressure of the fluid at the downhole location over a time interval to determine pressure values corresponding to different times within the time interval;

decoding the pressure values to establish a detected pressure profile;

comparing the detected pressure profile with the target pressure profile; and instructing an actuation mechanism to operate in response to identifying a match by the comparing;

operating the actuation mechanism, in response to the instructing, to induce movement of a release member from a first position to a second position;

releasing a plunger under the bias of a biasing member by movement of the release member from the first position to the second position; and inducing a wellbore tool to move between distinct operational configurations within the wellbore by the operating of the actuation mechanism, movement of the release member to the second position and releasing of the plunger under the bias of the biasing member.

11. The method according to claim 10, wherein comparing the detected pressure profile with the target pressure profile includes determining whether the detected pressure profile includes at least one minimum time interval over which a specific pressure is maintained between upper and lower tolerances.

12. The method according to claim 11, wherein comparing the detected pressure profile with the target pressure profile further includes determining whether the detected pressure profile includes a plurality of minimum time intervals over which an incrementally-stepped plurality of pressure levels is maintained between upper and lower tolerances and at least one maximum time interval interposed between the minimum time intervals of the incrementally-stepped plurality of pressure levels.

13. The method according to claim 10, wherein generating the wireless signal includes increasing a pump rate to cause the detected pressure profile to include a threshold pressure that is exceeded within a minimum time interval.

14. The method according to claim 10, further comprising inducing failure of a barrier member to establish fluid communication between a fluid chamber and a relief chamber to thereby induce movement of the release member from the first position to the second position with respect to the fluid chamber.

15. A downhole apparatus comprising:

a tubular string operable for deployment into a wellbore;

a sensor coupled to the tubular string, the sensor operable to detect a pressure profile conveyed through the tubular string;

a decoder operably coupled to the sensor, the decoder operable to compare the pressure profile detected to a target pressure profile;

an actuator operably coupled to the decoder such that the decoder instructs the actuator to operate when the pressure profile detected matches the target profile;

a release member operably coupled to the actuator to move from a first position to a second position in response to operation of the actuator;

a plunger biased by a biasing member, the plunger constrained from movement when the release member is in the first position and permitted to move under the bias of the biasing member when the release member is in the second position; and a wellbore tool operably coupled to the plunger such that the wellbore tool is maintained in an initial configuration until the actuator is operated and is induced to transition to a distinct operational configuration by the operation of the actuator, movement of the release member to the second position and movement of the plunger under the bias of the biasing member.

16. The downhole apparatus according to claim 15, wherein the wellbore tool comprises a circulation valve operable to selectively direct fluid between an interior and exterior of the tubular string.

17. The downhole apparatus according to claim 15, wherein the actuator comprises a barrier member fluidly isolating an actuator fluid in a fluid chamber from a relief chamber, and an actuation mechanism operable to induce failure of the barrier member to thereby establish fluid communication between the fluid chamber and the relief chamber.

18. The downhole apparatus according to claim 15, wherein the actuator is housed in a sidewall of the of the tubular string.

19. The downhole apparatus according to claim 15, wherein the wellbore tool comprises a barrier valve operable to selectively permit or restrict flow through the tubular string.

* * * * *